United States Patent [19]

Miyoshi et al.

[11] Patent Number: 4,670,377

[45] Date of Patent: Jun. 2, 1987

[54] SILVER HALIDE PHOTOGRAPHIC LIGHT-SENSISTIVE MATERIAL

[75] Inventors: Masanobu Miyoshi; Shun Takada; Kaoru Onodera, all of Odawara, Japan

[73] Assignee: Konishiroku Photo Industry Co., Ltd., Tokyo, Japan

[21] Appl. No.: 789,718

[22] Filed: Oct. 21, 1985

[30] Foreign Application Priority Data

Oct. 23, 1984 [JP] Japan ..... 59-223450

[51] Int. Cl.[4] ..... G03C 1/02; G03C 1/30

[52] U.S. Cl. ..... 430/621; 430/581; 430/584; 430/626

[58] Field of Search ..... 430/626, 584, 581

[56] References Cited

U.S. PATENT DOCUMENTS

| | | | |
|---|---|---|---|
| 3,622,318 | 11/1971 | Evans | 430/377 |
| 3,642,908 | 2/1972 | Burness et al. | 106/125 |
| 3,645,743 | 2/1972 | Mucke et al. | 430/622 |
| 3,676,143 | 7/1972 | Himmelmann et al. | 430/622 |
| 3,689,274 | 9/1972 | Sobel et al. | 430/622 |
| 3,881,933 | 5/1975 | Kumai et al. | 430/623 X |
| 4,088,495 | 5/1978 | Habu et al. | 430/623 |

FOREIGN PATENT DOCUMENTS 1158263 7/1969 United Kingdom .

*Primary Examiner*—John E. Kittle
*Assistant Examiner*—Mukund J. Shah
*Attorney, Agent, or Firm*—Jordan B. Bierman

[57] ABSTRACT

A silver halide photographic light-sensitive material comprising a support bearing thereon a photographic layer comprising a light-sensitive silver halide emulsion layer and a non-light-sensitive hydrophilic colloidal layer; wherein at least one of the photographic layers is hardened by a vinylsulfone hardener, and at least one layer selected from the group consisting of the photographic layers each hardened by the vinylsulfone hardener and the other photographic layers is hardened by a triazo compound, and further at least one of the silver halide emulsion layers contains silver halide particles which are spectrally sensitized by one of certain sensitizing dyes.

4 Claims, No Drawings

SILVER HALIDE PHOTOGRAPHIC LIGHT-SENSISTIVE MATERIAL

BACKGROUND OF THE INVENTION

This invention relates to a silver halide photographic light-sensitive material and, more particularly, to a light-sensitive material in which the latent image decay is improved and the pressure resistance is excellent in a moist atmosphere.

The progress of silver halide emulsion technology and the developments of various photographic raw materials have between them increased by leaps and bounds the sensitivity of light-sensitive materials. However, as the sensitivity is increased, it has brought out new problems.

One of the new problems is a light-sensitive fog caused by an infra-red sensitive sensor (hereinafter called an infrared sensor fog) having very often been used in recent years in a production process or in an automated process such as those for the printers, processors and the like of light-sensitive materials.

The emission spectral wavelengths of the above-mentioned infrared sensitive sensors are, for example, 900 to 950 nm in the typical Ga-As liquid phased epitaxial type infrared emission diodes, about 1140 nm in the similar ones using Si, and about 1880 nm in the similar ones using Ge, though the wavelengths are varied in various ranges according to the light emitting members.

The above-mentioned infrared sensor fog tends to be displayed more in red light-sensitive dyes because of its spectral absorption characteristics. To avoid this tendency, there have been many studies on the application of filter-dyestuffs of antifoggants, and on the arrangements of light-sensitive material layers. There have, however, been none of good results as yet.

Another one of the new problems is pressure marks. Generally, light-sensitive materials are applied by various pressures. Such pressures are usually applied thereto when the sensitive-material is being manufactured (i.e., in its cutting or splitting process), when it is being used (i.e., pressures applied thereto in a camera body, or a bend caused by hand of a photographer), when it is being processed (i.e., its transport through an automatic processor) and in the like case.

When various pressures are applied to a light-sensitive material as mentioned above, the silver halide particles of the light-sensitive material are also applied with pressure through gelatin which is the binder, so that the so-called pressure mark phenomenon (a pressure desensitization in some case) is to be produced.

This phenomenon has so far been well-known as a photographic pressure effect. There are the description thereof in the literatures such as T. H. James, 'The Theory of the Photographic Process', 4th Ed., by MacMillan Publishing Co., New York, p. 24; and D. Dautrich, F. Granzer and E. Moiser, 'J. Phot. Sci.', 21 p. 221, 1973. And, it is well-known in the art that the larger the particle size of a high speed silver halide are, the easier the pressure fog and the pressure desensitization are produced, because such particles are sensitive to pressure.

There are two cases that a light-sensitive material is applied with a pressure in a dry state in one case, and it is applied with a pressure in a wet state where a development is being processed in the other case. The pressure resistance of the light-sensitive material is desirably improved in the above-mentioned two cases.

There have been the attempts for providing light-sensitive materials which are less effected by pressure. For example, the technique for improving the pressure resistance of silver halide emulsions have been disclosed in Japanese Patent Open to Public Inspection (hereinafter called Japanese Patent O.P.I. Publication) No. 13923/1982 in which a coupler containing layer contains a high boiling solvent in an amount of not less than 20% by weight of the binders thereof; in Japanese Patent Examined Publication No. 12133/1980 in which describes the technique of lowering a pressure by containing polyol; in Japanese Patent Examined Publication No. 36978/1975 in which couplers and a conversion emulsion are used; and in Japanese Patent O.P.I. Publication No. 149933/1980 in which epitaxial silver halide particles are used. In the above-mentioned technique, however, any satisfactory effects have not been obtained in both of a dry state and a moist state, that is, how things stand at present.

Japanese Patent Application No. 60421 describes that a certain kind of red light-sensitive sensitizing dyes and a chlorotriazine compound are used in combination so as to reduce the above-mentioned infrared sensor fog. It was however proved that the above-mentioned combination has the other disadvantages that the combination cannot display any effect on the pressure resistance in a moist state and has a latent image decay (i.e., a phenomenon that the latent image of an imagewise exposed light-sensitive material is decayed with the passage of time.).

SUMMARY OF THE INVENTION

It is an object of the invention to provide a light-sensitive material in which no infrared sensor fog is caused, and the latent image decay property is improved and further the pressure resistance is remarkably excellent in a moist state.

The inventors have devoted themselves to various studies on silver halide emulsion from both of the aspects of the photographic characteristics and pressure characteristics thereof, and resultantly they have found that the above-mentioned object of the invention can be achieved by such a light-sensitive material as mentioned below.

To be more concrete, the light-sensitive material comprises a support bearing thereon a photographic layer comprising a light-sensitive silver halide emulsion layer and a non-light-sensitive hydrophilic colloidal layer, in which at least one of the photographic layers is hardened with a vinylsulfone hardener, and at least one layer selected from the group consisting of the photographic layer hardened with the vinylsulfone hardener and the other photographic layers is hardened with a compound represented by the following Formula [I] or [II], and further at least one layer of the above-mentioned silver halide emulsion layers contains silver halide particles spectrally sensitized with the sensitizing dyes represented by the following Formula [III], [IV] or [V];

Formula [I]

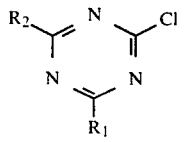

wherein $R_1$ represents chlorine, a hydroxy group, an alkyl group, an alkoxy group, an alkylthio group, an —OM group (in which M represents a monovalent metal atom), a —NR'R" group (in which R' and R" each represent hydrogen, an alkyl group or an aryl group), or a —NHCOR''' group (in which R''' represents hydrogen, an alkyl group or an aryl group); and $R_2$ represents the synonymous group represented by $R_1$ except chlorine.

Formula [II]

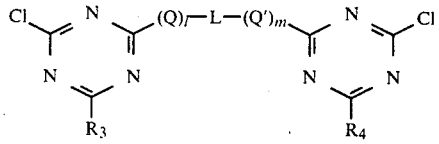

wherein $R_3$ and $R_4$ each represent chlorine, a hydroxy group, an alkyl group, an alkoxy group or an —OM group (in which M represents a monovalent metal atom); Q and Q' each represent a linking group selected from the group consisting of —O—, —S— and —NH—; L represents an alkylene group or an arylene group; and l and m each represent 0 or 1.

Formula [III]

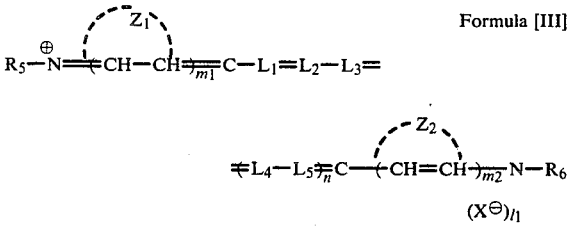

Formula [IV]

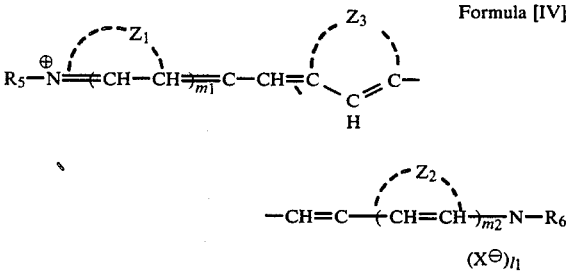

wherein $R_5$ and $R_6$ each represent an alkyl group or an aryl group; $L_1$, $L_2$, $L_3$, $L_4$ and $L_5$ each represent a methine group; $Z_1$ and $Z_2$ each represent a group of atoms necessary for completing an oxazole ring, a thiazole ring or a selenazole ring; $Z_3$ represents a group of hydrocarbon atoms necessary for forming a 6-membered ring; $X^{\ominus}$ represents an acid anion; and $m_1$, $m_2$, n and $l_1$ each are an integer of 0 or 1, provided that l is 0 if the compound forms an intermolecular salt.

Formula [V]

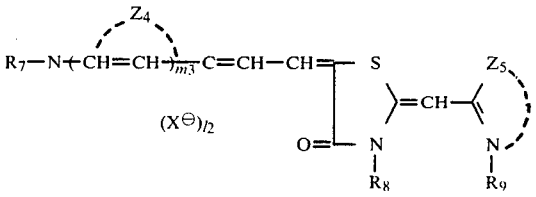

wherein $Z_4$ represents a group of non-metal atoms necessary for constituting a quinoline ring; $Z_5$ represents a group of atoms necessary for constituting a thiazole ring, a benzothiazole ring, a naphthiazole ring, a benzoxazole ring, a naphthoxazole ring, a benzoselenazole ring or a naphthoselenazole ring; $R_7$, $R_8$, and $R_9$ each represent an alkyl group; $X^{\ominus}$ represents an acid anion; and $m_3$ and $l_2$ each are an integer of 0 or 1.

DETAILED DESCRIPTION OF THE INVENTION

The vinylsulfone hardeners which are to be used in the invention include, for example, such an aromatic compound as described in German Pat. No. 1,100,942; such an alkyl compound bound with a hetero atom as described in Japanese Patent Examined Publication Nos. 29622/1969 and 25373/1972; such a sulfonamide ester compound as described in Japanese Patent Examined Publication No. 8736/1972; 1,3,5-tris[β-(vinylsulfonyl)-propionyl]-hexahydro-s-triazine such as described in Japanese Patent O.P.I. Publication No. 24435/1974; such as alkyl compound as described in Japanese Patent O.P.I. Publication No. 44164/1976; and the like.

The typical examples thereof are given below, and it is, however, to be understood that the invention shall not be limited thereto.

H-1

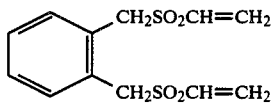

H-2 $O(CH_2CH_2SO_2CH{=}CH_2)_2$

H-3 $NH(CH_2CH_2SO_2CH{=}CH_2)_2$

H-4

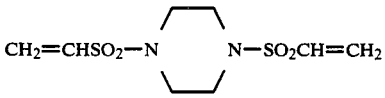

H-5

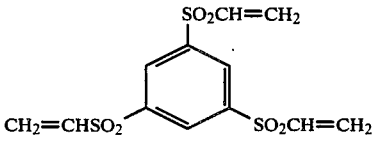

H-6

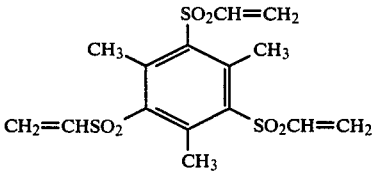

-continued

H-7

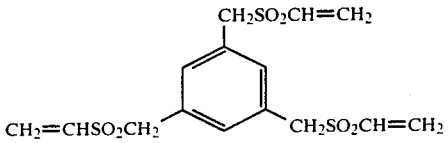

H-8 $CH_3C(CH_2OCH_2SO_2CH{=}CH_2)_3$

H-9 $C(CH_2OCH_2SO_2CH{=}CH_2)_4$

H-10 $N(CH_2CH_2OCH_2SO_2CH{=}CH_2)_3$

H-11

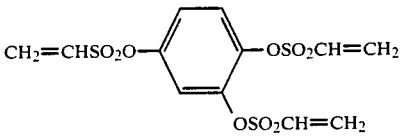

H-12

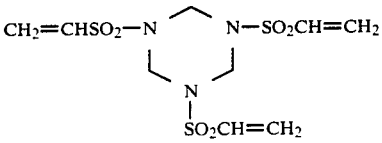

H-13 $C_2H_5C(CH_2SO_2CH{=}CH_2)_3$

H-14 $C_8H_{17}C(CH_2SO_2CH{=}CH_2)_3$

H-15 $CH_2{=}CHSO_2CH_2CH(SO_2CH{=}CH_2)CH_2SO_2CH{=}CH_2$

H-16 $(CH_2{=}CHSO_2CH_2)_3CCH_2Br$

H-17 $(CH_2{=}CHSO_2CH_2)_2CHCH(CH_2SO_2CH{=}CH_2)_2$

H-18 $(CH_2{=}CHSO_2CH_2)_3CCH_2OCH_2C(CH_2SO_2CH{=}CH_2)_3$

H-19 $C(CH_2SO_2CH{=}CH_2)_4$

H-20

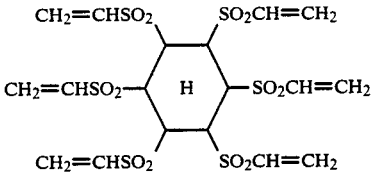

H-21 $(CH_2{=}CHSO_2CH_2)_3CCH_2SO_2CH_2CH_2Cl$

H-22

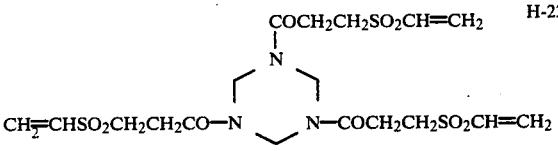

The vinylsulfone hardeners which are to be used in the invention include, as well as the above-exemplified compounds, such a compound having at least three vinylsulfone groups in the molecular structure thereof including, for example, a reacted product obtained by reacting one of the exemplified compounds H-5 through H-22 with a compound having a group capable of reacting with a vinylsulfone group and a water-soluble group, such as diethanolamine, thioglycolic acid, a sarcosine sodium salt, or a taurine sodium salt.

Next, the compounds represented by the aforegiven Formula [I] or [II], which are to be used in the invention will now be described.

In the Formulas [I] and [II], the alkyl groups, alkoxy groups and alkylthio groups each represented by $R_1$ include an alkyl group having one to 3 carbon atoms, such as methyl, ethyl, methoxy, ethoxy, methylthio or ethylthio group or the like.

M representing the monovalent metal atoms of —OM groups represented by $R_1$ include, for example, sodium, potassium, ammonium and the like; and the alkyl groups represented by R′ and R″ of the —NR′R″ groups include an alkyl group having 1 to 3 carbon atoms, such as a methyl or ethyl group; and the aryl groups thereof include a phenyl group.

Further, the alkyl groups and the aryl groups each represented by R‴ of the —NHCOR‴ group represented by $R_1$ are synonymous with the alkyl groups and the aryl groups represented by R′ and R″ mentioned above.

$R_2$ represents the synonymous groups represented by the above-mentioned $R_1$ including chlorine, as mentioned above.

Next, the groups each represented by the $R_3$ and $R_4$ are synonymous with the groups represented by the above-mentioned $R_1$.

The alkylene groups each represented by L include, for example, an alkylene groups each having 1 to 3 carbon atoms such as a methylene group, an ethylene group and the like. The arylene groups include, for example, a phenylene group.

Still further, the typical examples of the hardeners relating to the invention, represented by the aforegiven Formulas [I] and [II] will be given below:

(I-1)

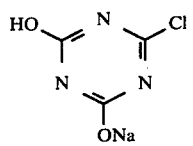

(I-2)

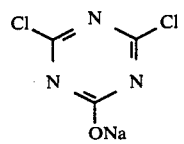

(I-3)

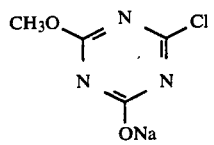

(I-4)

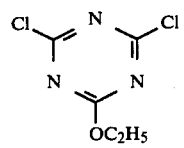

(I-5)

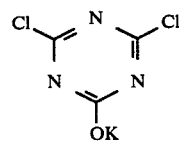

(I-6)

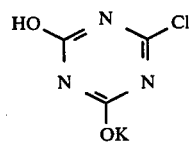

-continued (I-7)

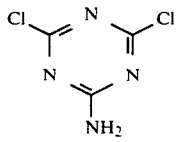

(I-8)

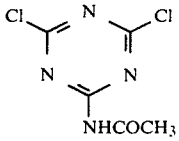

(I-9)

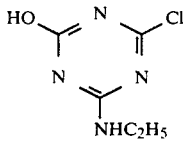

(II-1)

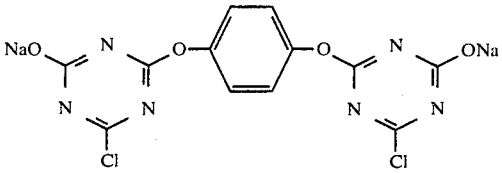

(II-2)

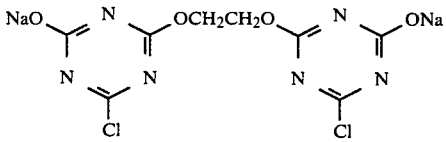

(II-3)

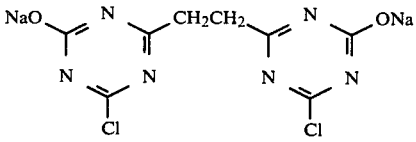

(II-4)

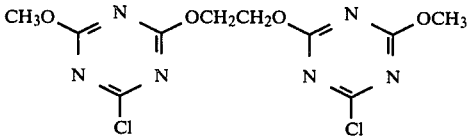

(II-5)

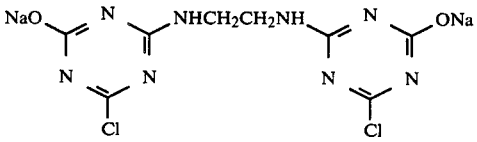

(II-6)

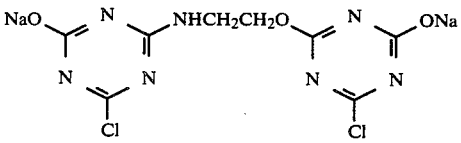

(II-7)

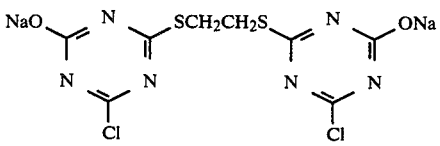

-continued (II-8)

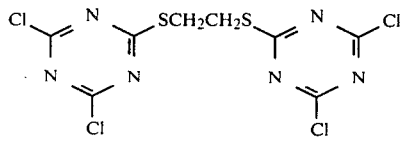

(II-9)

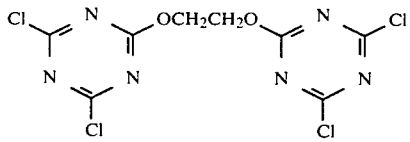

How to add the aforementioned vinylsulfone hardeners relating to the invention and the hardeners represented by the Formula [I] or [II] to a silver halide emulsion layer or other component layers is to dissolve the hardener in water or a water-miscible solvent such as methanol, ethanol or the like so as to be added in a coating liquid for the component layers. The methods of adding them are allowed to use either of a batchwise addition method add an in-line addition method. The point of time of such addition thereof is not specially limited, and it is, however, desired to add them immediately before coating.

These hardeners are to be added in an amount of from 0.5 mg to 100 mg per gram of the gelatins to be coated, and preferably from 2.0 mg to 50 mg.

Next, there will now be described about the sensitizing dyes which are to be used in the invention and are represented by the Formulas [III], [IV] and [V].

The alkyl groups represented by $R_5$ and $R_6$ in the Formulas [III] and [IV] are allowed to be branched or to have an unsaturated bonding, and are more preferably those having not more than 10 carbon atoms and also having a halogen atoms or the substituents of sulfo, aryl, carboxy, amine (of primary, secondary and tertiary), alkoxy, aryloxy, hydroxy, alkoxycarbonyl, acyloxy or the like. The typical examples thereof are given as follows: The groups of methyl, ethyl, sulfobutyl, benzyl, phenethyl, carboxymethyl, dimethylaminopropyl, methoxyethyl, phenoxypropyl, methylsulfonylethyl, cyclohexyl, octyl, decyl, carbamoylethyl, sulfophenethyl, sulfobenzyl, 2-hydroxy-3-sulfopropyl, ethoxycarbonylethyl, 2,3-disulfopropoxypropyl, sulfopropoxyethoxyethyl, trifluoroethyl, carboxybenzyl, cyanopropyl, p-carboxyphenethyl, ethoxy carbanylmethyl, pivaloylpropyl, propionylethyl, anisyl, acetoxyethyl, benzoyloxypropyl, chloroethyl, N-ethylaminocarbonylpropyl, allyl, 2-butynyl, cyanoethyl, and the like.

The aryl groups represented by $R_5$ and $R_6$ include, for example, a phenyl group, a carboxyphenyl group, a sulfophenyl group, and the like.

When the methine group represented by $L_1$, $L_2$ and $L_3$ has a substituent, such methine group is represented by the formula (—CR=) in which the substituent R represents a straight-chain or branched-chain alkyl group such as methyl group, ethyl group, carboxymethyl group and benzyl group; an alkoxy group such as methoxy group and ethoxy group; and an aryl group such as phenyl group and tolyl group; each having carbon atoms of the order of from 1 to 8.

The typical examples of the thiazole nucleus, selenazole nucleus or oxazole nucleus which is completed by $Z_1$ and $Z_2$ denoted in the Formulas [III] and [IV] may be give below;

Thiazole, 4-methylthiazole, 5-phenylthiazole, 4,5-dimethylthiazole, benzothiazole, 5-chlorobenzothiazole, 6-chlorobenzothiazole, 3-methylbenzothiazole, 6-methylbenzothiazole, 5-bromobenzothiazole, 5-carboxybenzothiazole, 5-ethoxycarbonylbenzothiazole, 5-hydroxybenzothiazole, 5-butylbenzothiazole, 5-pivaloyaminobenzothiazole, 6-benzoylaminobenzothiazole, 5-acetylbenzothiazole, 6-acetylaminobenzothiazole, 5-phenylbenzothiazole, 6-methoxybenzothiazole, 5-iodebenzothiazole, 5-methoxy-6-methylbenzothiazole, tetrahydrobenzothiazole, 5-phenoxybenzothiazole, 5-phenethylbenzothazole, 5-cyanobenzothiazole, naphtho[1,2-d]thiazole, naphtho[2,1-d]thiazole, naphtho[2,3-d]thiazole, 5-ethoxynaphtho[1,2-d]thiazole, 8-methoxynaphtho[2,1-d]thiazole, 5-methoxythionaphtho[6,7-d]thiazole, 4,5-dihydronaphtho[2,1-d]thiazole, thieno[2,3-d]thiazole, 4-methylselenazole, 4-phenylselenazole, benzoselenazole, 5-chlorobenzoselenazole, 5-methylbenzoselenazole, 5-methoxybenzoselenazole, 5,6-dimethylbenzoselenazole, tetrahydrobenzoselenazole, naphtho[1,2-d]selenazole, naphtho[2,1-d]selenazole, 4-methyloxazole, 5-methyloxazole, 5-phenyloxazole, 4,5-dimethyloxazole, benzoxazole, 5-chlorobenzoxazole, 5-methylbenzoxazole, 5-phenylbenzoxazole, 5-methoxybenzoxazole, 5,6-dimethylbenzoxazole, 5-phenethylbenzoxazole, 5-carboxybenzoxazole, 5-hydroxybenzoxazole, 5-phenoxybenzoxazole, 5-acetylbenzoxazole, 5-methyl-6-chlorobenzoxazole, naphtho[1,2-d]oxazole, naphtho[2,1-d]oxazole, naptho[2.3-d]oxazole, and the like.

The acid anions each represented by X denoted in the Formulas [III] and [IV] include, for example, chlorine ion, bromine ion, iodine ion, perchloric acid ion, fluoroboric acid ion, p-toluenesulfonic acid ion, ethylsulfonic acid ion, nitric acid ion, and the like.

The especially useful sensitizing dyes among the sensitizing dyes represented by the aforegiven Formulas [III] and [IV] may be represented by the following Formulas [IIIa] and [IVa].

Formula [IIIa]

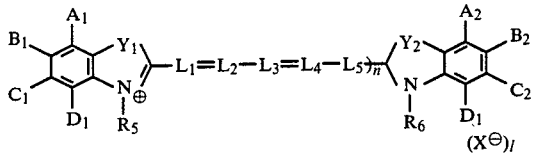

Formula [IVa]

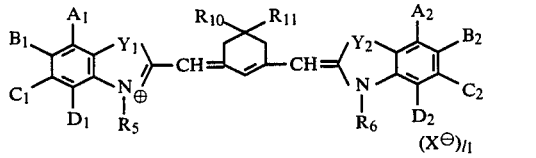

wherein $Y_1$ and $Y_2$ represent oxygen, sulfur or selenium; and $R_{10}$ and $R_{11}$ each represent a lower alkyl group.

$A_1$, $A_2$, $B_1$, $B_2$, $C_1$, $C_2$, $D_1$ and $D_2$ each represent hydrogen, a halogen, an alkyl group, an alkoxy group, a phenyl group, a cyano group, a nitro group, or an alkoxycarbonyl group; and there may be formed a benzene ring by the condensation of at least one of the respective combinations of $A_1$ and $B_1$, $B_1$ and $C_1$, $C_1$ and $D_1$, $A_2$ and $B_2$, $B_2$ and $C_2$, and, $C_2$ and $D_2$.

In $A_1$, $A_2$, $B_1$, $B_2$, $C_1$, $C_2$, $D_1$ and $D_2$ and denoted in the Formulas [IIIa] and [IVa], the alkyl group represented thereby is a straight-chained or branch-chained lower alkyl group such as methyl group, ethyl group, butyl group or trifluoromethyl group each having carbon atoms of the order of 1 to 5; the alkoxy group represented thereby is a straight-chained or branch-chained alkyloxy group having carbon atoms of the order of 1 to 5, such as methoxy group, ethoxy group or the like; the halgoen atoms represented thereby are fluorine, chlorine, bromine and iodine; the phenyl groups represented thereby include, for example, a phenyl group, hydroxyphenyl group and carboxyphenyl group each having no substituent; and the alkoxycarbonyl groups represented thereby include, for example, a methoxycarbonyl group and ethoxycarbonyl group.

$R_5$, $R_6$, $L_2$, $L_3$, $L_4$, $L_5$, $X^{\ominus}$, n and $l_1$ each are synonymous with those described in the aforegiven Formulas [III] and [IV], provided than n is more preferable to be 1.

In the invention, when the quinoline ring comprising $Z_4$ of the Formula [V] as the component thereof has a substituent, such substituents include, for example, a halogen, an alkyl group, an alkoxy group, a hydroxy group, a cyano group, a carboxy group, an alkoxycarbonyl group, and alkylamino group, an acylamino group, an acyl group, a phenyl group, a cyclohexyl group and the like. The typical examples of the quinoline rings comprising $Z_4$ as the component thereof include, for example, 2-quinoline, 6-chloro-2-quinoline, 6-methyl-2-quinoline, 6-methoxy-2-quinoline, 7-methyl-2-quinoline, 8-methyl-2-quinoline, 6-hydroxy-2-quinoline, 4-quinoline, 6-methyl-4-quinoline, 6-ethoxy-4-quinoline, 6-chloro-4-quinoline, 6-hydroxy-4-quinoline, 6-phenyl-4-quinoline, 7-methyl-4-quinoline, 8-methyl-4-quinoline, and the like.

When a substituent is in the thiazole ring, benzothiazole ring, nephthothiazole ring, benzoxazole ring, naphthoxazole ring, benzoselenazole ring or naphthoselenazole ring comprising $Z_5$ as the component thereof, such substituents include, for example, a halogen, an alkyl group, an alkoxy group, a hydroxy group, a cyano group, a carboxy group, an alkoxycarbonyl group, an alkylamino group, an acyamino group, an acyl group, a phenyl group, a cycloalkyl group, and the like.

The typical examples of the thiazole rings each comprising $Z_5$ as the component thereof include, for example, those each of thiazole, 4-phenylthiazole, 4,5-diphenylthiazole, 4-methylthiazole, 5-methylthiazole, 4-chlorothiazole, 4-methoxythiazole or the like; the benzothiazole rings include, for example, those each of benzothiazole, 5-chlorobenzothiazole, 5-phenylbenzothiazole, 5-methylbenzothiazole, 5-methoxybenzothiazole, or the like; and the naphthothiazole rings include, for example, those each of α-naphthothiazole, β-naphthothiazole, 5-methoxy-β-naphthothiazole, 8-methoxy-α-nephthothiazole, 8-chloro-α-naphthothiazole, or the like.

The benzoxazole rings each comprising $Z_5$ as the component thereof include, for example, those each of benzoxazole, 5-chlorobenzoxazole, 5-phenylbenzoxazole, 5-methylbenzoxazole, 5-methoxybenzoxazole, or the like; or the like; and the naphthoxazole ring include, for example, those each of α-naphthoxazole, β-naphthoxazole, 5-methoxy-β-naphthoxazole, 5-methyl-β-naphthoxazole, 8-methoxy-α-napthoxazole, 8-chloro-α-naphthoxazole, or the like.

The benzoselenazole rings each comprising $Z_5$ as the component thereof include, for example, those each of benzoselenazole, 5-chlorobenzoselenazole, 5-phenylbenzoselenazole, 5-methylbenzoselenazole, 5-methoxybenzoselenazole, or the like; and the naphthoselenazole rings include, for example, α-naphthoselenazole, β-naphthoselenazole, 5-methoxy-β-naphthoselenazole, 8-methoxy-α-naphthoselenazole, 8-chloro-α-naphthoselenazole, or the like.

The alkyl groups each represented by $R_7$, $R_8$ or $R_9$ denoted in Formula [V] are of the straight-chained or the branch-chained, which include, for example, a methyl group, an ethyl group, a n-propyl group, an i-propyl group, a n-butyl group, or the like.

The acid anions each represented by $X^{\ominus}$ denoted in Formula [V] include, for example, chlorine ion, bromine ion, iodine ion, perchloric acid ion, fluoroboric acid ion, p-toluene sulfonic acid ion, ethylsulfonic acid ion, methylsulfonic acid ion, nitric acid ion, or the like.

In the case that the compounds represented by Formula [V] form an intermolecular salt, $l_2$ is zero.

The typical examples of the sensitizing dyes each represented by Formula [III], [V] are given below, and it is to be understood, however, that the invention shall not limited thereto.

D-1

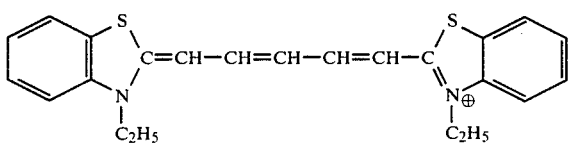

$I^{\ominus}$

D-2

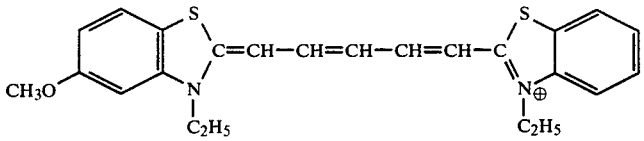

$I^{\ominus}$

D-3

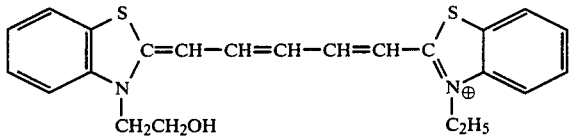

$I^{\ominus}$

D-4

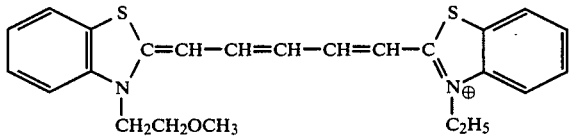

$Br^{\ominus}$

D-5

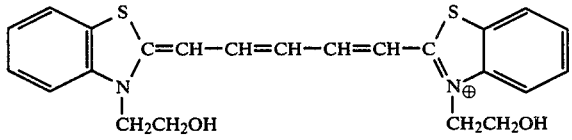

$Br^{\ominus}$

D-6

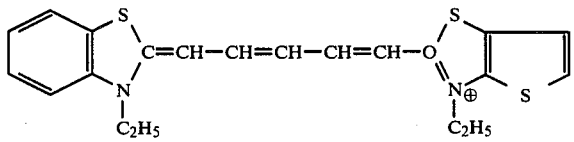

$Br^{\ominus}$

-continued
D-7
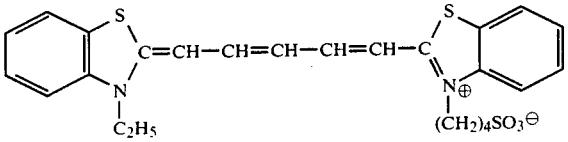
D-8
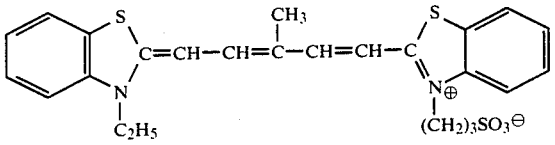
D-9
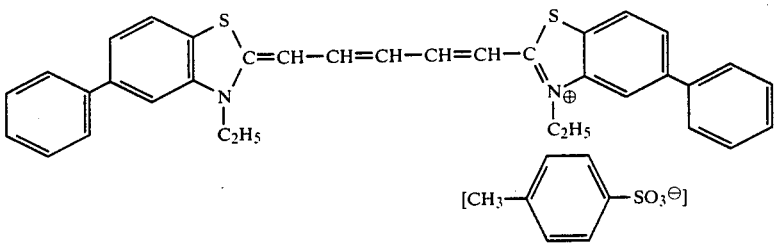
D-10
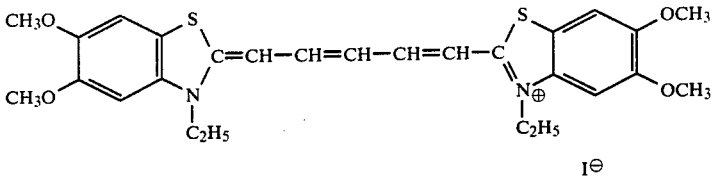
D-11
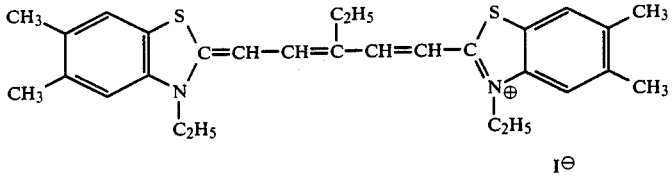
D-12
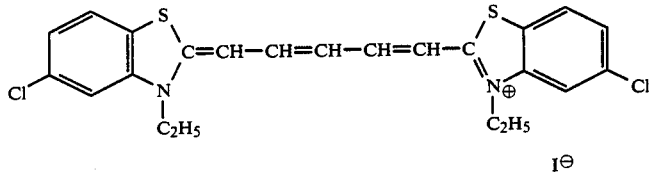
D-13
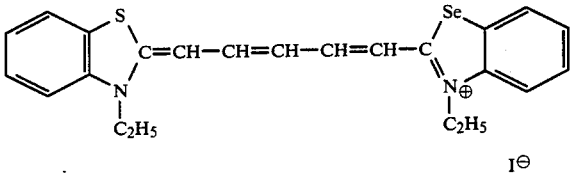
D-14
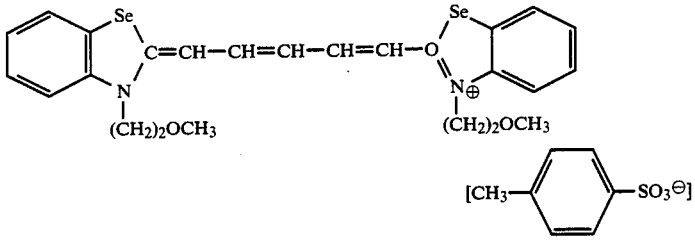

-continued
D-15
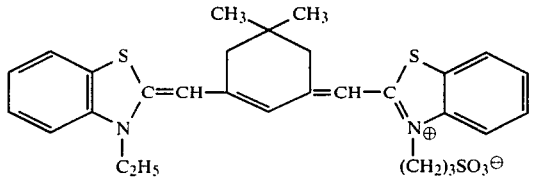
D-16
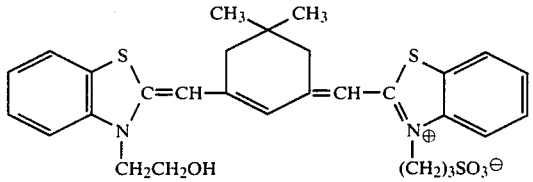
D-17
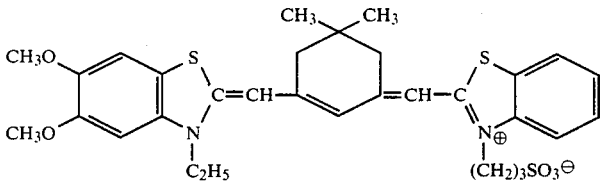
D-18
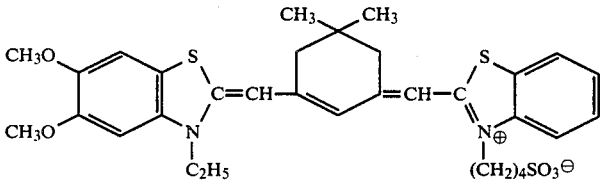
D-19
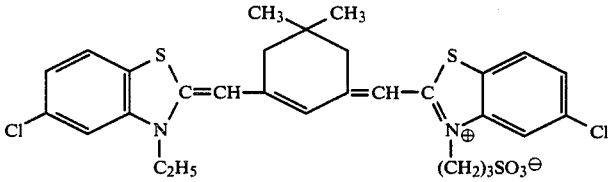
D-20
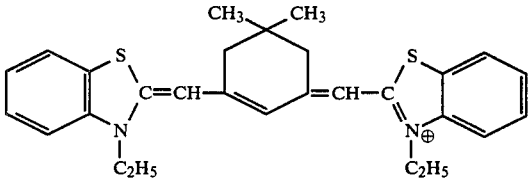
$I^{\ominus}$
D-21
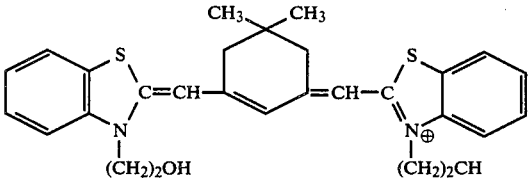
$Br^{\ominus}$ -continued
D-22
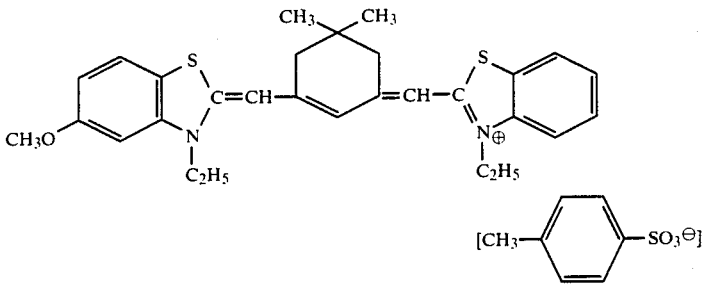
D-23
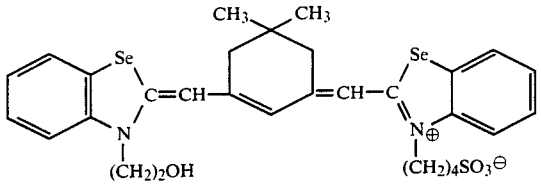
D-24
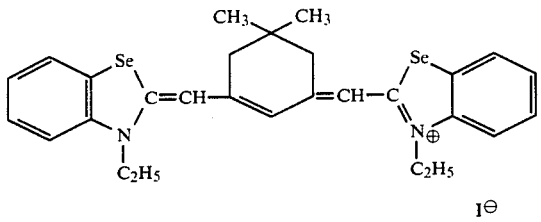
D-25
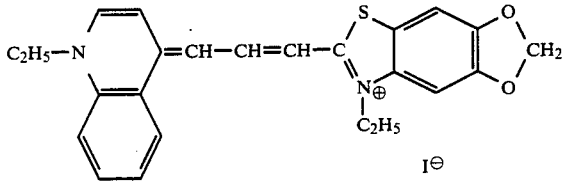
D-26
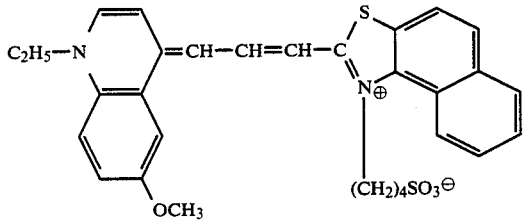
D-27
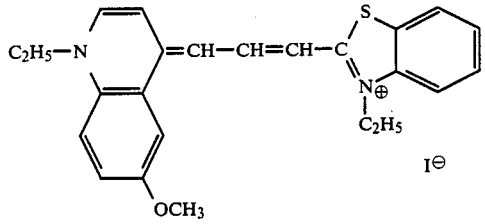
D-28
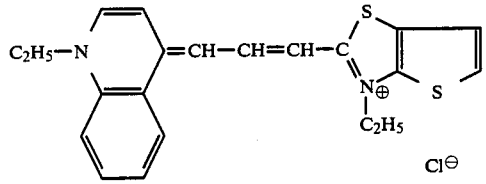

-continued
D-29
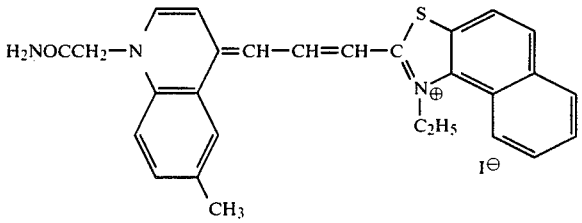
D-30
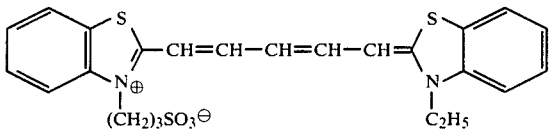
D-31
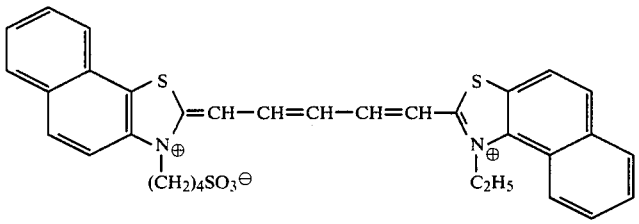
D-32
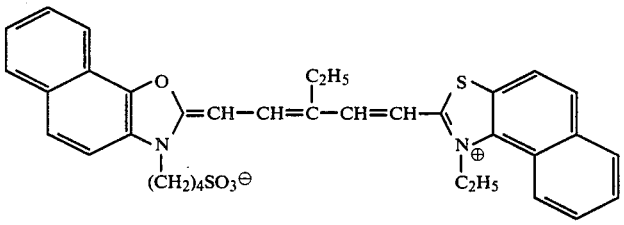
D-33
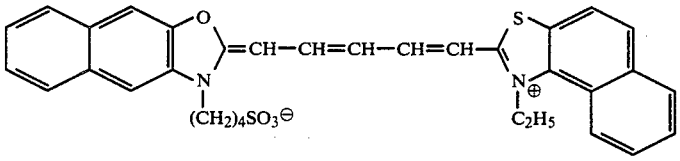
D-34
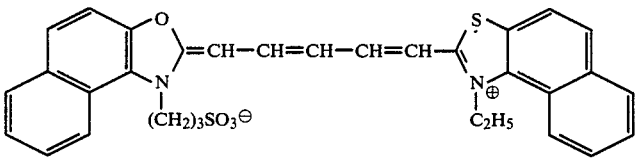
D-35
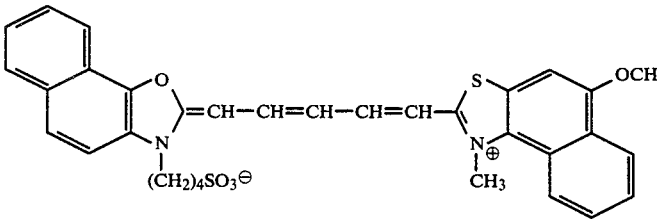

-continued
D-36
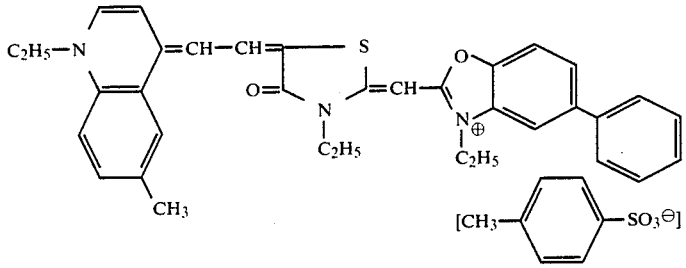
D-37
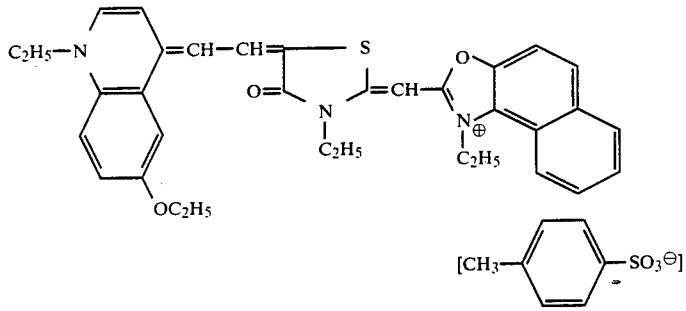
D-38
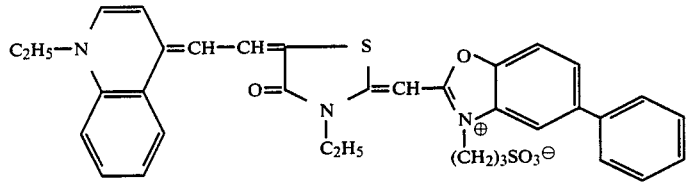
D-39
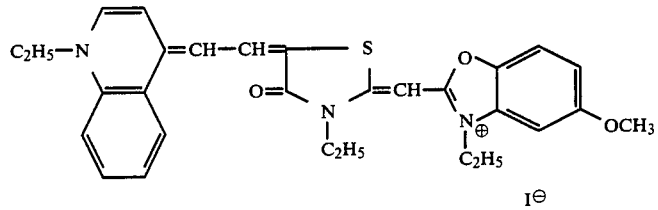
D-40
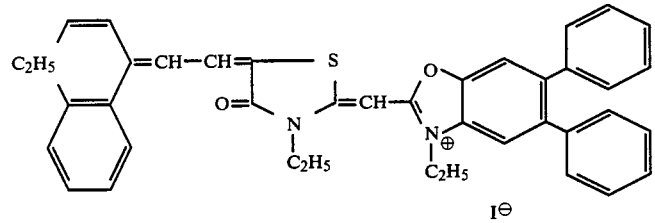
D-41
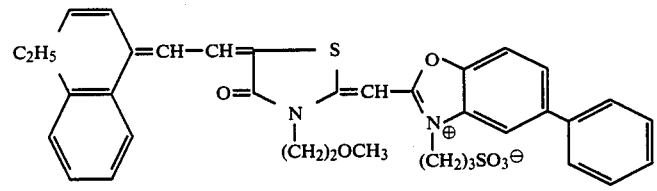

-continued
D-42
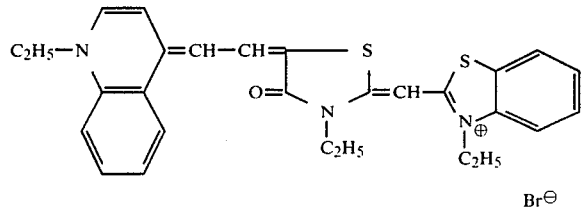
D-43
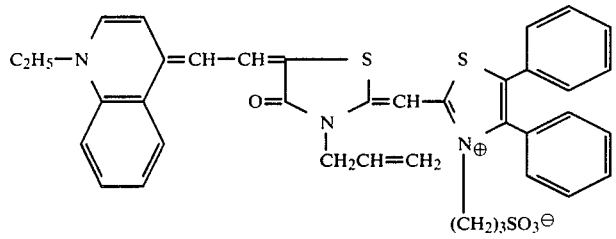
D-44
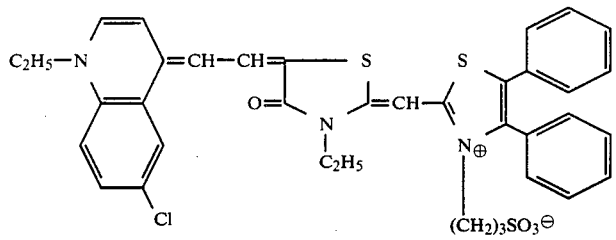
D-45
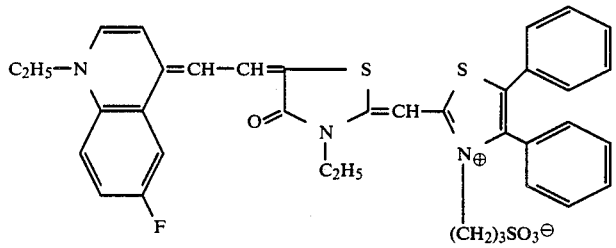
D-46
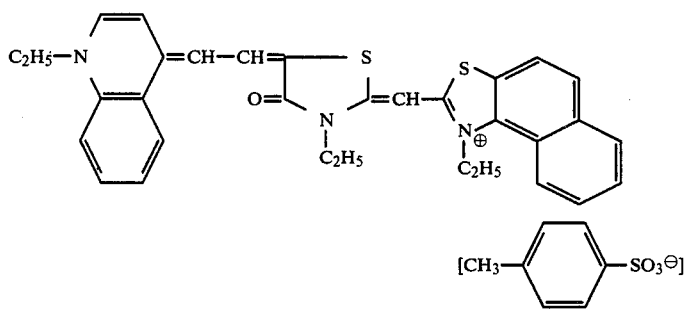
D-47
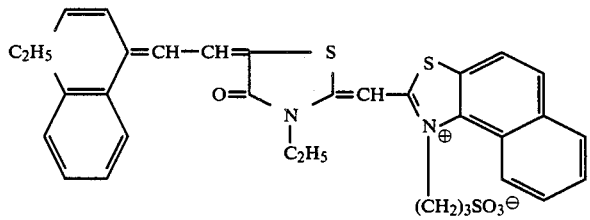

-continued

D-48

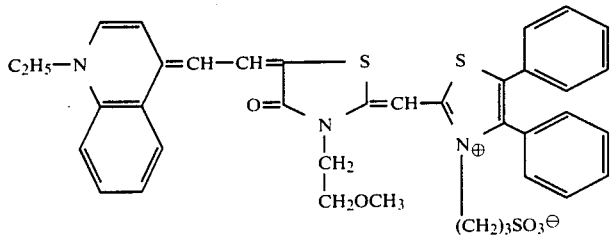

The point of time of adding the sensitizing dyes relating to the invention represented by Formula [III], [IV] or [V] may be any point in the course of an emulsion preparing process. It is, however, preferred to add in the course of the chemical ripening process of the emulsion or after the chemical ripening process thereof, and more, preferably in the course of the chemical ripening process. The amount thereof added is from $10^{-7}$ mole to $10^{-3}$ mole, and preferably from $5\times10^{-6}$ mole to $5\times10^{-4}$ mole.

Silver halide particles forming a silver halide emulsion of the invention may be of the multidisperse type or of the monodisperse type. The monodisperse type silver halide particles are more preferable from the viewpoint of that a high sensitization can be achieved without increasing fogs.

In the monodisperse type silver halide particles of the invention, the configuration and sizes of each particle are observed as uniform when observing through an electron microscopic photography, and the particles have such a particle size distribution as defined by the following formula in which a value obtained by dividing a standard deviation S of a particle size distribution by an average particle size $\bar{\gamma}$ is not more than 0.20 and more preferably not more than 0.15. (It is also called that the particle distribution is not more than 15%).

$$S = \sqrt{\frac{\Sigma(\bar{\gamma} - \gamma i)^2 ni}{\Sigma ni}}$$

$$\frac{S}{\bar{\gamma}} \leqq 0.20$$

An average particle size called herein means the diameter thereof when the particles are those of a silver halide in spheric configurations, and it means an average value of the diameters in terms of circular images of the same area converted from the projected images of the particles when they are in configuration other than a cube or sphere; and $\gamma$ is defined by the following formula, provided that the particle size of an individual particle is $\gamma i$, and the number of the individual particles is ni;

$$\bar{\gamma} = \frac{\Sigma ni\gamma i}{\Sigma ni}$$

The above-mentioned particle diameters may be measured in a variety of the methods having popularly been used in the art with the above-mentioned purpose. The typical measuring methods are described in R.P. Loveland, 'Particle Size Analysis', A.S.T.M. Symposium on Light Microscopy, 1955, pp. 94–122, or Mess and James, 'The Theory of the Photographic Process' 3rd Ed., Chapter 2, Macmillan Publishing Co., 1966. The above-mentioned particle sizes can be measured by making use of the projected area or the approximate value of the diameter of the particle. When particles are substantially uniform in configuration, the particle distribution thereof may considerably be defined in terms of a projected area or the diameter thereof.

The relation between particle size distribution may be determined in accordance with the method described in Trivelli and Smith, 'The Experimental Relation Between the Sensitometric Distribution and the Particle Size Distribution in Photographic Emulsions', The Photographic Journal, Vol. LXXIX, 1949, pp. 330–338.

The silver halide particles forming a silver halide emulsion which is to be used in the invention are allowed to have any crystal habit of a cube, octahedron, dodeca hedron or tetradeca hedron. The effects of the invention will be displayed more eminently when tetradeca hedral particles are used.

The silver halide which are to be used in the invention include, for example, silver chloride, silver bromide, silver iodide, silver chlorobromide, silver iodobromide, silver chloroiodobromide and the like which are popularly used in photographic emulsions.

The silver halide particles used in the invention may be treated in a variety of chemical sensitizing processes which are generally used. Namely, they may be chemically sensitized by making use of the chemical sensitizers or the like, independently or in combination, including, for example, an active gelatin; a noble metal sensitizer such as a water-soluble gold salt, a water-soluble platinum salt, a water-soluble palladium salt, a water-soluble rhodium salt, a water-soluble iridium salt, and the like; a sulfur sensitizer; a selenium sensitizer; a reduction sensitizer such as a polyamine, stannous chloride, and the like.

It is also allowed to coexist the silver halide particles of the invention and a cadmium salt, a zinc salt, a lead salt, a thallium salt, an iridium salt and the complex salts thereof, a rhodium salt and the complex salts thereof, an iron salt and the complex salts thereof, and the like together, in the process of forming or physical ripening the silver halide particles. In particular, it is desired to use an iridium salt, because the effects of the invention can be promoted to display.

There is no particular limitation to the methods of optically sensitizing the silver halide emulsions of the invention, except the method that an emulsion layer containing silver halide particles is optically sensitized by the sensitizing dyes represented by the aforegiven formulas. For example, the silver halide emulsions of the invention can be optically sensitized (e.g., supersensitized) by making use independently or in combination of an optical sensitizers including, for example, a cyanine dye such as zeromethine dye, monomethine dye, dimethine dye, trimethine dye and the like; or a merocyanine dye. The above-mentioned techniques are also described in U.S. Pat. Nos. 2,688,545, 2,912,329, 3,397,060, 3,615,635, and 3,628,964; British Patent Nos. 1,195,302, 1,242,588, and 1,293,862; West Germany OLS Patent Nos. 2,030,325 and 2,121,780; Japanese Patent Examined Publication Nos. 4936/1968 and 14030/1969; and the like. These techniques may be arbitrarily selected in accordance with a wavelength region to be sensitized, sensitivity and the purposes or usage of a light-sensitive material subject to sensitization.

The silver halide emulsions which are to be used in the invention are also allowed to be added with a variety of additives which are usually used, so as to meet the purposes. These additives include, for example, a stabilizer and an antifoggant such as those of an azaindene, a triazole, a tetrazole, an imidazolium salt, a tetrazolium salt, a polyhydroxy compound or the like; a development accelerator such as benzyl alcohol, a polyoxyethylene compound or the like; an image stabilizer such as those of a chroman, a coumaran, a bisphenol, or a phosphorous acid ester; a lubricant such as a wax, a gryceride of a higher fatty acid, a higher alcohol ester of a higher fatty acid, or the like. A variety of surfactants may also be used, such as a coating assistant, a permeability improving agent for processing liquids and the like, a defoaming agent, or an anion type, cation type, non-ion type or amphoteric surfactant serving as the raw-material for controlling various physical properties of a light-sensitive material. The effective antistatic agents include, for example, an alkaline salt of the reactants of p-aminobenzene sulfonic acid with diacetyl cellulose, styrene perfluoroalkylsodium maleate copolymer or styrene-maleic acid anhydydride copolymer, and the like. The matting agents include, for example, polymethyl methacrylate, polystyrene, an alkali-soluble polymer, and the like. In addition, silicon oxide is also usable. The latexes to be added for improving the physical properties of layers include, for example, a copolymer of an acrylic acid ester, a vinyl ester or the like with a monomer having the other ethylene group. The gelatin-plasticizers, include, for example, grycerol and grycol compounds. The thickeners include, for example, a copolymer of styrene-sodium maleate, a copolymer of alkylvinylether-maleic acid, and the like.

The supports of the light-sensitive materials prepared of the silver halide emulsions of the invention prepared as mentioned above, such supports include, for example, a baryta paper, a polypropylene synthetic paper, a glass plate, a polyethylene-coated paper, a cellulose acetate film, a cellulose nitrate film, a polyvinyl acetal film, a polypropylene film, a polyester film such as a polyethylene terephthalate film, a polystyrene film, and the like. A suitable support is selected from these supports according to the purpose of using a light-sensitive material, and, in the invention, a polyethylene coated paper or a polypropylene synthetic paper is preferably used.

These supports may also be sublayered, if occasion demands.

The silver halide emulsions of the invention can effectively be applied to the light-sensitive materials capable of being used for various usage such as for general black-and-white photography, X-ray photography, color photography, infrared photography, micro photography, a silver dye bleaching process, reversal photography, a diffusion-transfer process, and the like.

In order to apply the silver halide emulsions to be used in the invention to a color light-sensitive material, the methods and the raw materials applicable to a color light-sensitive material may be used, in which, for example, cyan magenta and yellow couplers are incorporated in combination into the emulsions adjusted to be red-sensitive, green-sensitive and blue-sensitive, respectively. As for such yellow couplers, the well-known open-chained ketomethylene couplers may be used. Among these couplers, a benzoylacetanilide compound and a pivaloylacetanilide compound are particularly useful.

As for the magenta couplers, a pyrazolone compound, an indazolone compound, a cyanacetyl compound and the like may be used. As for the cyan couplers, a phenol compound, a naphthol compound and the like may be used.

The light-sensitive materials prepared of the silver halide emulsions of the invention may be developed after an exposure to light in any well-known process usually used.

Black-color developers are an alkaline solution containing such a developing agent as a hydroxybenzene, an aminophenol, an aminobenzene or the like, and they may also contain a sulfite, carbonate, hydrogensulfite, bromide, iodide or the like of the other alkali metals. When the light-sensitive materials are for color photographic use, they may be color-developed in an ordinary color developing process which is usually used. In a reversal photographic process, a color-development is made in such a manner that the first development is made in a black-and-white negative development process, and next, a white exposure is given or a treatment is made in a bath containing a fogging agent, and the color-development is made with an alkaline developer containing a color developing agent. There is no special limitation to the processing methods thereof, but any processing methods are applicable thereto. For example, such applicable methods include, typically, the method in which after a color developing, a bleach-fix process is carried out and a washing and stabilizing processes are further carried out if required, or in which after a color developing, a bleaching and a fixing are carried out separately, and a washing and stabilizing process are carried out if required.

The useful color developing agents for color developments include, for example, an aromatic primary amine compound such as N,N-diethyl-p-phenylenediamine, N-ethyl-N-hydroxyethyl-p-phenyleneidamine, 4-(N-ethyl-N-hydroxyethyl)amino-2-methylaniline, 4-(N-ethyl-N-$\beta$-methanesulfonamidoethyl)-amino-2-methylaniline, 4-(N,N-diethyl)amino-2-methylaniline, 4-(N-ethyl-N-methoxyethyl)amino-2-methylaniline, and the sulfates, hydrochloride, sulfites, p-toluenesulfonates and the like thereof.

The preferable bleaching agents for developed silver are polyvalent metal salts of organic acids including the ferric salts of organic acid as an example thereof. The typical examples include, for example, the iron salts of nitrilotriacetic acid, diethyltriaminepentaacetic acid, ethyleneglycolbis(aminoethylethere)tetraacetic acid, diaminopropanoltetraacetic acid, N-(2-hydroxyethyl)ethylenediamine triacetic acid, ethyliminodipropionic acid, cyclohexanediamine tetraacetic acid, ethylenediaminetetraacetic acid, or the like. Besides the above, it is also allowed to use the iron salts of a polycarbonic acid described in Japanese Patent O.P.I. Publication No. 107737/1974, such as the iron salts of oxalic acid, malonic acid, succinic acid, tartaric acid, malic acid, citric acid, salicylic acid and the like. As for the polyvalent metals, besides the above-mentioned ferric salts, a cupric salt and a cobalt(II) salt may also be used. Further, such an inorganic polyvalent metal salts as ferric chloride, ferric sulfate and the like may also be used according to the purposes of using a light-sensitive material. As for the fixing agents, a thiosulfate a thiocyanate and the like which have so far been well-known may be used. In addition, such a water-soluble alkali metal salt or the bromides or iodides of ammonium such as potassium bromide, ammonium bromide, sodium bromide and the like described in Japanese Patent O.P.I. Publication No. 101934/1973 may be incorporated thereinto.

EXAMPLES

A detailed description of the invention will now be made below with reference to the following examples, and it is, however, to be understood that the invention shall not be limited thereto.

EXAMPLE 1

The method described in Japanese Patent O.P.I. Publication No. 45437/1983 was applied to an aqueous solution of 5% deactivated gelatin to keep the temperature thereof at 50° C. and to adjust the pAg value to 7.5, and a silver chlorobromide emulsion containing 20 mole% of silver chloride was prepared in a double-jet method. (Hereinafter called EM-1).

From the results of observation through an electron microscope and the measurements of the particle sizes thereof, it was found that this emulsion was a monodisperse emulsion having tetradecahedral normal crystals each comprising (100) faces and (111) faces of which the average particle size was 0.4 μm and the particle distribution was 12%.

This EM-1 was divided into three parts, and sodium thiosulfate and the sensitizing dyes D-8, D-15 and D-38 relating to the invention were added thereto, respectively, and each of them was chemically ripened. Thus, EM-2, EM-3 and EM-4 emulsions were obtained, respectively.

Separately from the above, a monodisperse type tetradecahedral emulsion was prepared in the same manner as in EM-1, except that $K_2IrCl_6$ of $1\times10^{-4}$ g per mole of the silver halide used were added in the course of producing silver chlorobromide in a double-jet method. The emulsion was further chemically ripened in the same manner as in EM-2, so that EM-5 was obtained.

Further, EM-6 was obtained in the same manner as in EM-1, except that the pAg value thereof was adjusted to 8.3. This EM-6 comprised normal octahedral crystals each having rounded edges, and the average particle size thereof was 0.47 μm and the particle distribution thereof was 14%. Still further, EM-7 was obtained by making use of EM-6 and then by chemically ripened in the same manner as in EM-2.

Next, 16 kinds of multilayered color light-sensitive materials (hereinafter called Sample No. 1 through No. 16) were prepared, respectively, by coating in order the following layers over to a paper support coated thereon with a polyethylene containing anatase-type titanium dioxide. In this case, EM-2, EM-3, EM-4, EM-5 and EM-7 were used in the red-sensitive emulsion layer.

Layer 1: Blue-sensitive emulsion layer

A blue-sensitive emulsion layer containing a blue-sensitive silver chlorobromide emulsion comprising 90 mole% of silver bromide and 0.35 g/m² of silver, yellow couplers called Y-1, dioctyl phthalate, and gelatin.

(Y-1)

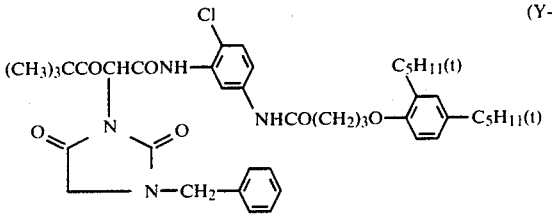

Layer 2: Interlayer

An interlayer mainly comprising gelatin.

Layer 3: Green-sensitive emulsion layer

A green-sensitive emulsion layer containing a green-sensitive silver chlorobromide emulsion comprising 80 mole% of silver bromide and 0.35 g/m² of silver, magenta couplers called M-1, dioctyl phthalate and gelatin.

(M-1)

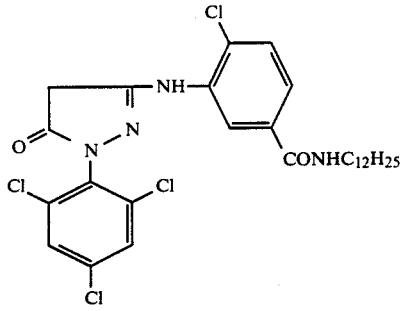

Layer 4: Interlayer

An interlayer containing gelatin, an ultraviolet-ray absorbing agent called UV-1, and a vinylsulfone hardener of the invention.

(UV-1)

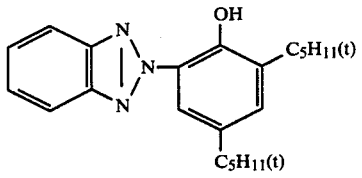

Layer 5: Red-sensitive emulsion layer

A red-sensitive emulsion layer containing a red-sensitive silver chlorobromide emulsion comprising 80 mole% of silver bromide and 0.3 g/m² of silver, cyan couplers called C-1, dioctyl phthalate, and gelatin.

(C-1)

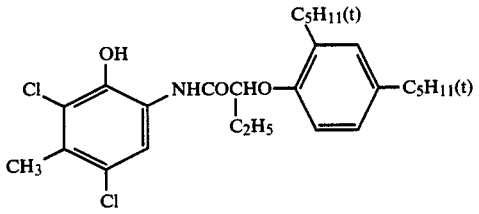

Layer 6: Interlayer

An interlayer containing gelatin and an ultraviolet-ray absorbing agent called UV-1.

Layer 7: Protective layer

A protective layer containing gelatin and a compound of the invention represented by Formula [I] or [II].

With respect to the obtained samples, the infrared sensor fog, the pressure resistance in a dry state, the pressure resistance in a wet state and the latent image stability thereof were evaluated in the following test methods, respectively. The results therefrom are shown in Table-1.

(1) Infrared sensor fog

The samples were exposed for 5 minutes and 5 mm away from the light-source of Sharp Infrared Emission Diode, GL-350 of gallium-arsenic type, and were then applied with the following treatments. The cyan concentrations of the treated samples were measured by making use of a Gretag D-122 Model densitometer.

| Processing step | Processing time | |
|---|---|---|
| Color developing | 3 min. | 30 sec. |
| Bleaching-fixing | 1 | 30 |
| Washing | 3 | 30 |
| Drying | 1 | — |

Composition of Color Developer:

| | |
|---|---|
| N—ethyl-N—β-methanesulfonamidoethyl-3-methyl-4-aminoaniline sulfate | 4.0 g |
| Hydroxyamine.sulfate | 2.0 g |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |
| Polyethylene glycol (Average polymerization degree: 400) | 3.0 ml |
| Add water to make 1 liter, and adjust the pH value to pH 10.0 by making use of sodium hydroxide. | |

Composition of Bleaching-fixing Solution:

| | |
|---|---|
| Iron sodium ethylenediaminetetraacetate | 60.0 g |
| Ammonium thiosulfate | 100.0 g |
| Sodium biphosphite | 20.0 g |
| Sodium metahydrogensulfite | 5.0 g |
| Add water to make 1 liter, and adjust the pH value to pH 7.0 by making use of sulfuric acid. | |
| Oxidation-reduction potential: −70 mV | |

(2) Pressure resistance in dry state

A sample is allowed to stand at 25° C. and 40%RH for not shorter than 2 hours, and then a ball-pointed needle having the ball-diameter of 0.1 mm is made perpendicular to the surface of the sample. The sample is kept moving in parallel with the surface thereof at the speed of 1 cm/sec., and at the same time a continuous and varied load of from 0 to 100 g is applied to the ball-pointed needle. The loads each of the ball-pointed needle are recorded every time when the cyan concentration of the sample is increased by the pressure variations. In this test, a pressure resistance in a dry state is to be evaluated at a high degree when the higher a load value is, the higher a pressure resistance in moist state:

(3) Pressure resistance in moist state

A sample is uniformly exposed to light and is the color developed at 33° C. by making use of the aforementioned color developer so that the cyan color concentration thereof can be 0.1 to 0.3 after the development. With keeping the color developing, a ball-pointed needle having the ball diameter of 0.3 mm is set perpendicularly to the surface of the sample placed in the color developer. The surface of the sample is moved in parallel at a speed of 1 cm/sec., and at the same time, the sample is developed in the same manner as in the above-mentioned infrared sensor fog test, except that continuous and varied loads of from 0 to 50 g are applied to the ball-pointed needle. The loads each of the ball-pointed needle are recorded every time when the cyan concentration of the sample is increased by the pressure variations. In this test too, a pressure resistance in a moist state is to be evaluated at a high degree when the higher a load value is, the more a pressure resistance is excellent.

(4) Latent image stability

A sample is exposed to light through an optical wedge and is allowed to stand at 40° C. and 40%RH for 24 hours, and is then developed in the same manner as in the aforementioned infrared sensor fog test. The cyan concentration of the resulted sample is measured by making use of a desitometer, Model D-122 manufactured by Gretag. The latent image density is expressed in terms of a density value obtained after the sample was allowed to stand, provided that a density obtained when it was developed immedately after the exposure is regarded relatively as 1.0. In this case, it is proved that the more a density value is closer to 1.0, the more a latent image stability is excellent.

TABLE 1

| Example No. | Red-sensitive emulsion | Compound [I] or [II] (mg/m²) | | Vinylsulfone hardeners (mg/m²) | | Infrared sensor fog | Pressure resistance in dry state (g) | Pressure resistance in moist state (g) | latent image stability |
|---|---|---|---|---|---|---|---|---|---|
| 1 (comparative) | EM-2 | I-1 | 100 | — | — | 0.03 | 42 | 11 | 0.81 |
| 2 (comparative) | " | — | — | H-19 | 190 | 0.15 | 15 | 28 | 0.96 |
| 3 (Invention) | " | I-1 | 50 | " | 85 | 0.03 | 40 | 26 | 0.95 |
| 4 (Invention) | " | " | 25 | " | 64 | 0.04 | 36 | 26 | 0.96 |
| 5 (Invention) | " | " | 75 | " | 21 | 0.03 | 41 | 21 | 0.93 |
| 6 (Invention) | " | II-2 | 100 | " | 85 | 0.03 | 39 | 27 | 0.94 |
| 7 (Invention) | " | " | " | H-12 | 120 | 0.03 | 37 | 24 | 0.94 |

TABLE 1-continued

| Example No. | Red-sensitive emulsion | Compound [I] or [II] (mg/m²) | | Vinylsulfone hardeners (mg/m²) | | Infrared sensor fog | Pressure resistance in dry state (g) | Pressure resistance in moist state (g) | latent image stability |
|---|---|---|---|---|---|---|---|---|---|
| 8 (Invention) | " | I-1 | 50 | " | " | 0.03 | 38 | 22 | 0.93 |
| 9 (comparative) | EM-3 | " | " | — | — | 0.03 | 39 | 12 | 0.83 |
| 10 (Invention) | " | " | " | H-19 | 85 | 0.03 | 39 | 29 | 0.95 |
| 11 (comparative) | EM-4 | " | " | — | — | 0.03 | 40 | 10 | 0.82 |
| 12 (Invention) | " | " | " | H-19 | 85 | 0.03 | 41 | 27 | 0.94 |
| 13 (comparative) | EM-5 | " | " | — | — | 0.03 | 48 | 15 | 0.84 |
| 14 Invention) | " | " | " | H-19 | 85 | 0.03 | 46 | 32 | 0.97 |
| 15 (comparative) | EM-7 | " | " | — | — | 0.03 | 36 | 8 | 0.88 |
| 16 (Invention) | " | " | " | H-19 | 85 | 0.03 | 35 | 25 | 0.94 |

It is obvious from the table that every one of the samples relating to the invention is less in infrared sensor fog, greater in pressure resistance in dry and moist states either, and excellent in latent image stability. In particular, Sample No. 14 which comprises monodisperse type emulsions in which dodecahedrally crystallized particles are produced in presence of an iridium salt is superior to any other samples in any one of the characteristics.

EXAMPLE 2

For the purpose of comparing the effects of the invention with those of the prior art, 8 kinds of Comparative Samples (No. 17 through No. 24) were prepared in the same manner as in Sample No. 1 of Example 1, except that, as shown in Table 2, the compounds P-1, P-2 and P-3 each capable of displaying the well-known effects on pressure resistance improvements were added to Layer 7 of the Example 1, and the compounds L-1, L-2 and L-3 each having so far been well-known that they are capable of inhibiting latent image decay were added to Layer 5 of the Example 1. These comparative samples together with the Samples 1, 3 and 14 prepared in Example 1 were tested and evaluated with respect to the pressure resistance in moist state and the latent image stability thereof, respectively. The results therefrom are shown in Table 2.

TABLE 2

| Sample No. | Pressure resistance improving agent | Latent image decay improving agent | Pressure resistance in moist state (g) | Latent image stability |
|---|---|---|---|---|
| 1 (Comparative) | — | — | 13 | 0.80 |
| 3 (Invention) | — | — | 28 | 0.96 |
| 14 (Invention) | — | — | 34 | 0.97 |
| 17 (Comparative) | P-1 | — | 15 | 0.81 |
| 18 (Comparative) | P-2 | — | 12 | 0.80 |
| 19 (Comparative) | P-3 | — | 11 | 0.85 |
| 20 (Comparative) | — | L-1 | 11 | 0.90 |
| 21 (Comparative) | — | L-2 | 11 | 0.93 |

TABLE 2-continued

| Sample No. | Pressure resistance improving agent | Latent image decay improving agent | Pressure resistance in moist state (g) | Latent image stability |
|---|---|---|---|---|
| 22 (Comparative) | — | L-3 | 10 | 0.87 |
| 23 (Comparative) | P-1 | L-1 | 12 | 0.92 |
| 24 (Comparative) | P-1 | L-2 | 9 | 0.92 |

<Comparative Compounds>
P-1 Liquid paraffin
P-2 Dioctylphthalate
P-3 $HOCH_2CH_2OH$ L-1
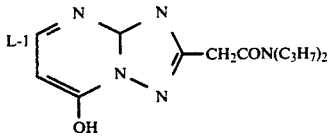

L-2
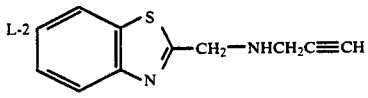

L-3
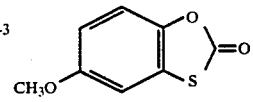

As is obvious from the table, any satisfactory improvement have not been achieved until the invention has been made, while the prior art displays the unsatisfactory improvement effects on pressure resistance in moist state and latent image stability.

What is claimed is:

1. A silver halide photographic light-sensitive material comprising a support bearing thereon a photographic layer comprising a light-sensitive silver halide emulsion layer and a non-light-sensitive hydrophilic colloidal layer; wherein at least one of the photographic layers is hardened by a vinylsulfone hardener, and at least one layer selected from the group consisting of the photographic layers each hardened by the vinylsulfone hardener and the other photographic layers is hardened by a compound represented by the following Formula [I] or [II], and further at least one of the silver halide emulsion layers contains silver halide particles which are spectrally sensitized by a sensitizing dye represented by the following Formula [III], [IV] or [V];

Formula [I]

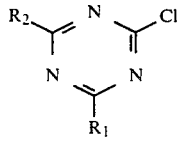

wherein $R_1$ represents chlorine, hydroxy group, an alkyl group, an alkoxy group, an alkylthio group, an —OM group (in which M represents a monovalent metal atom), a —NR'R" group (in which R' and R" each represent hydrogen, an alkyl group or an aryl group), or a —NHCOR''' group (in which R''' represents hydrogen, an alkyl group or an aryl group); and $R_2$ represents the synonymous group represented by $R_1$ except chlorine.

Formula [II]

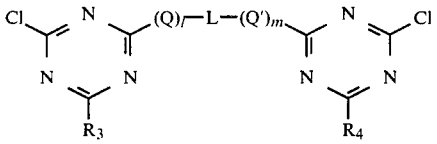

wherein $R_3$ and $R_4$ each represent chlorine, a hydroxy group, an alkyl group, an alkoxy group or an —OM group (in which M represents a monovalent metal atom); Q and Q' each represent a linking group selected from the group consisting of —O—, —S— and —NH—; L represents an alkylene group or an arylene group; and l and m each represent 0 or 1.

Formula [III]

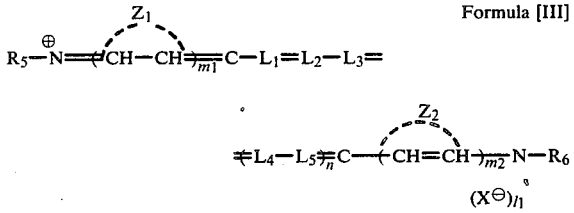

Formula [IV]

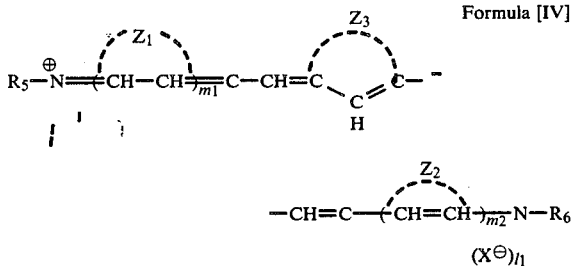

wherein $R_5$ and $R_6$ each represent an alkyl group or an aryl group; $L_1$, $L_2$, $L_3$, $L_4$ and $L_5$ each represent a methine group; $Z_1$ and $Z_2$ each represent a group of atoms necessary for completing an oxazole ring, a thiazole ring or a selenazole ring; $Z_3$ represents a group of hydrocarbon atoms necessary for forming a 6-membered ring; $X^{\ominus}$ represents an acid anion; and $m_1$, $m_2$, n and $l_1$ each are an integer of 0 or 1, provided that l is 0 if the compound forms an intermolecular salt.

Formula [V]

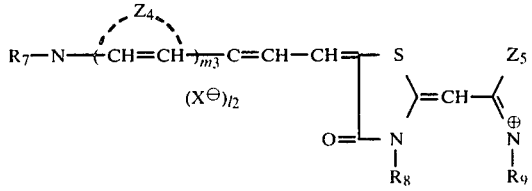

wherein $Z_4$ represents a group of non-metal atoms necessary for constituting a quinoline ring; $Z_5$ represents a group of atoms necessary for constituting a thiazole ring, a benzothiazole ring, a naphthothiazole ring, a benzoxazole ring, a naphthoxazole ring, a benzoselenazole ring or a naphthoselenazole ring; $R_7$, $R_8$, and $R_9$ each represent an alkyl group; $X^{\ominus}$ represents an acid anion; and $m_3$ and $l_2$ each are an integer of 0 or 1.

2. The silver halide photographic light-sensitive material of claim 1 wherein said sensitizing dye is selected from the dyes represented by the following Formula [IIIa] or [IVa]

Formula [IIIa]

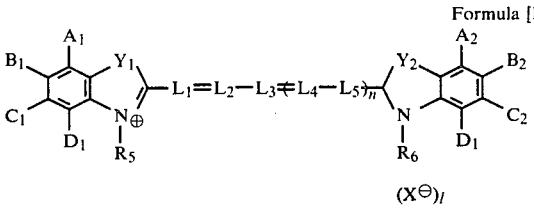

Formula [IVa]

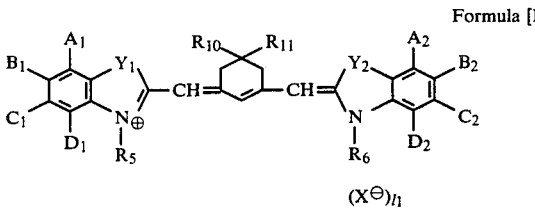

wherein $Y_1$ and $Y_2$ are selected from the group consisting of an oxygen atom, a sulfur atom and a selenium atom, $R_{10}$ and $R_{11}$ independently represent a lower alkyl group, $A_1$, $A_2$, $B_1$, $B_2$, $C_1$, $C_2$, $D_1$ and $D_2$ are independently selected from the group consisting of a hydrogen atom, a halogen atom, an alkyl group, an alkoxy group, a phenyl group, a cyano group, a nitro group, and a alkoxycarbonyl group; and there may be formed a benzene ring by condensation of at least one of the respective combination of $A_1$ and $B_1$, $B_1$ and $C_1$, $C_1$ and $D_1$, $A_2$ and $B_2$, $B_2$ and $C_2$, and $C_2$ and $D_2$.

3. The silver halide photographic light-sensitive material of claim 1 wherein said silver halide particles spectrally sensitized by the sensitizing dye represented by Formula [III], [IV] or [V] are tetradecahedral and are in the monodispersed state of not more than 0.15 of $S/\overline{\gamma}$, in which S represents a standard deviation of a particle size distribution and $\overline{\gamma}$ represents an average particle size of the silver halide particles.

4. The silver halide photographic light-sensitive material of claim 1 wherein said silver halide particles spectrally sensitized by the sensitizing dye represented by Formula [III], [IV] or [V] contain from $10^{-9}$ to $10^{-5}$ mol of a water soluble iridium compound per mol of silver halide.

* * * * *